US005289247A

United States Patent [19]

Takano et al.

[11] Patent Number: 5,289,247

[45] Date of Patent: Feb. 22, 1994

[54] IMAGE FORMING APPARATUS WITH CHANGEABLE FEED INTERVAL FOR CONTINUOUS FEED

[75] Inventors: Manabu Takano, Machida; Masahiro Goto; Koichi Suwa, both of Yokohama, all of Japan

[73] Assignee: Canon Kabushiki Kaisha, Tokyo, Japan

[21] Appl. No.: 904,254

[22] Filed: Jun. 25, 1992

[30] Foreign Application Priority Data

Jun. 28, 1991 [JP] Japan ..... 3-158482

[51] Int. Cl.[5] ..... G03G 15/20; G03G 21/00

[52] U.S. Cl. ..... 355/285; 355/208; 355/282

[58] Field of Search ..... 355/208, 282, 285, 286, 355/289, 290, 295

[56] References Cited

U.S. PATENT DOCUMENTS 4,595,274 6/1986 Sakurai ..... 355/290
4,595,279 6/1986 Kuru et al. ..... 355/282
4,652,110 3/1987 Sato et al. ..... 355/282 X
4,878,092 10/1989 Arai ..... 355/285
4,883,715 11/1989 Kuge et al. ..... 428/421
4,933,724 6/1990 Sugimoto et al. ..... 355/289
5,032,874 7/1991 Matsuuchi ..... 355/285

FOREIGN PATENT DOCUMENTS 2-29770 1/1990 Japan ..... 355/282
2-298980 12/1990 Japan ..... 355/282
3-249769 11/1991 Japan ..... 355/282

*Primary Examiner*—Fred L. Braun
*Attorney, Agent, or Firm*—Fitzpatrick, Cella, Harper & Scinto

[57] ABSTRACT

A feed interval of continuous feeding is changed according to the set temperature of a heating member or the size of a recording material, or a feed interval is long for a predetermined time after a state for forming an image is established and is then decreased after the predetermined time has passed, thereby causing a slight increase in the temperature of the non-passage portion.

10 Claims, 13 Drawing Sheets

IMAGE FORMING APPARATUS WITH CHANGEABLE FEED INTERVAL FOR CONTINUOUS FEED

BACKGROUND OF THE INVENTION

1. Field of the Invention

The present invention relates to an image forming apparatus such as a copying machine, a printer and the like and to one which uses an electrophotographic recording method, an electrostatic recording method and the like. Particularly, the present invention relates to an image forming apparatus which is capable of continuously feeding recording materials, each holding an unfixed image thereon to fixing means.

2. Description of the Related Art

Conventional image forming apparatuses frequently use as a fixing device a heat-contact type fixing device having high thermal efficiency and safety, and particularly a heat roller type fixing device comprising a pair of rollers.

However, the surface temperature of the fixing roller can be nonuniform because the surface temperature of a passage region of the fixing roller through which recording material passes decreases from the passage of the recording materials while heat is not easily absorbed from a non-passage region of the fixing roller. The temperature nonuniformity occurs when the recording materials are continuously passed through the surface of the fixing roller. In this case, if the temperature is set in view of the passage region, the temperature of the non-passage region is significantly higher.

This phenomenon becomes a problem when the set temperature of the fixing roller is changed, when the size of the recording material is changed or for a while after the surface of the fixing roller is brought into a state permitting image formation.

This problem occurs in the heat roller type, a film heating type which uses a thermal heater and a thin film heater and the like.

SUMMARY OF THE INVENTION

It is an object of the present invention to provide an image forming apparatus that minimizes the increase in the temperature of a non-passage portion.

It is another object of the present invention to provide an image forming apparatus which permits a feed interval to be changed from a value at a first set temperature of a heating member to a value at a second set temperature thereof during continuous feeding.

In one aspect of the invention, there is provided an image forming apparatus having means for fixing an unfixed image on a recording material, the fixing means comprising a heating member, selectively maintainable at one of at least a first set temperature and a second set temperature that is different from said first set temperature. A backup member forms a nip with the heating member to convey a recording material holding an unfixed image thereon through the nip to fix the unfixed image and feed means are supplied for continuously feeding recording materials on which there is an unfixed image to the fixing means. A feed interval control means switches between a first feed interval at the first set temperature and a second feed interval at the second set temperature.

In another aspect of the invention, there is provided an image forming apparatus having a heating member for fixing, temperature means for maintaining the heating member at a predetermined set temperature during fixing, and a backup member forming a nip with the heating member to convey a recording material holding an unfixed image through the nip to fix the unfixed image. Feed means are provided for continuously feeding recording materials at intervals to the nip. A size detection means detects the size of a recording material and a feed interval control means controls the feed interval of the recording material on the basis of the results of the detection of size by the size detection means.

In still another aspect of the invention, there is provided an image forming apparatus with a heating member for fixing, temperature means for maintaining the heating member at a predetermined set temperature during fixing and a backup member for forming a nip with the heating member to convey a recording material supporting an unfixed image through the nip to thereby fix the image. In this aspect of the invention there is also provided a feed means for continuously feeding recording materials at intervals to the nip and a feed interval control means for initially setting a first feed interval during continuous feeding of recording materials and subsequently changing the, first feed interval to a second feed interval that is shorter than the first feed interval.

Other objects of the present invention are apparent from the description below.

DESCRIPTION OF THE PREFERRED EMBODIMENTS

Figure 3:
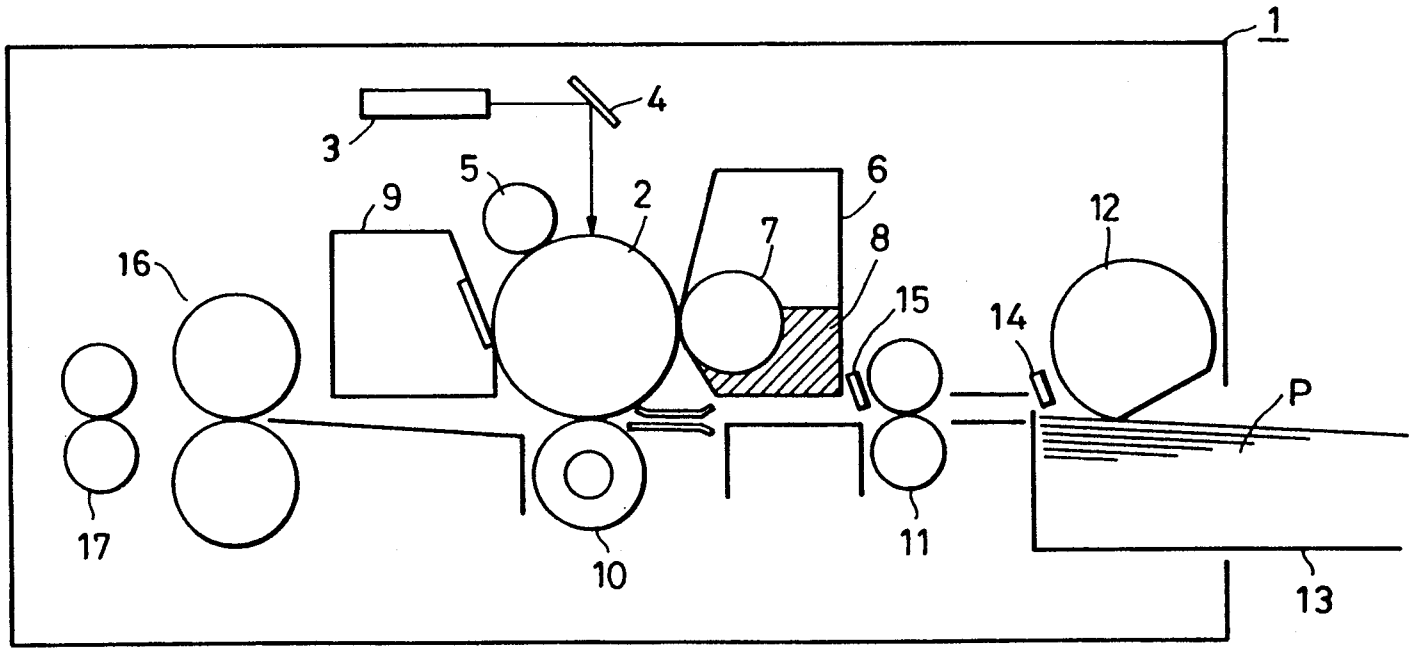
FIG. 3 is a cross-sectional view of an image forming apparatus of the present invention.

FIG. 3 is a cross-sectional view explaining the construction of an image forming apparatus of the present invention. FIG. 3 shows a laser printer as an example. The construction and operation of the apparatus are described below.

The surface of a photosensitive body (photosensitive drum ) 2 is uniformly charged using a charge roller 5. An image on the photosensitive drum 2 is exposed by a laser scanner 3 to form a latent image on the photosensitive drum 2. The latent image is then developed by toner 8 contained in a developing device 6. Recording materials P loaded in a paper cassette 13 are fed by a paper feeding roller 12, and the size of a recording material is detected by a trailing end detection sensor 14 before the recording material is sent to register rollers 11.

The recording material P is detected by the sensor 15 and is in a stand-by state while its leading end is being held between the register rollers 11. When the recording material P is sent to a recording roller 10 in synchronism with the toner image on the photosensitive drum 2, the toner image is transferred to the recording material P. The toner 8 transferred to the recording material P is fixed by a fixing device 16, and the recording material P is discharged to the outside of the apparatus by discharge rollers 17.

Toner 8 remaining on the photosensitive drum 2 after recording is cleaned off by a cleaner 9, and the recording material is moved to the subsequent process.

Figure 4:
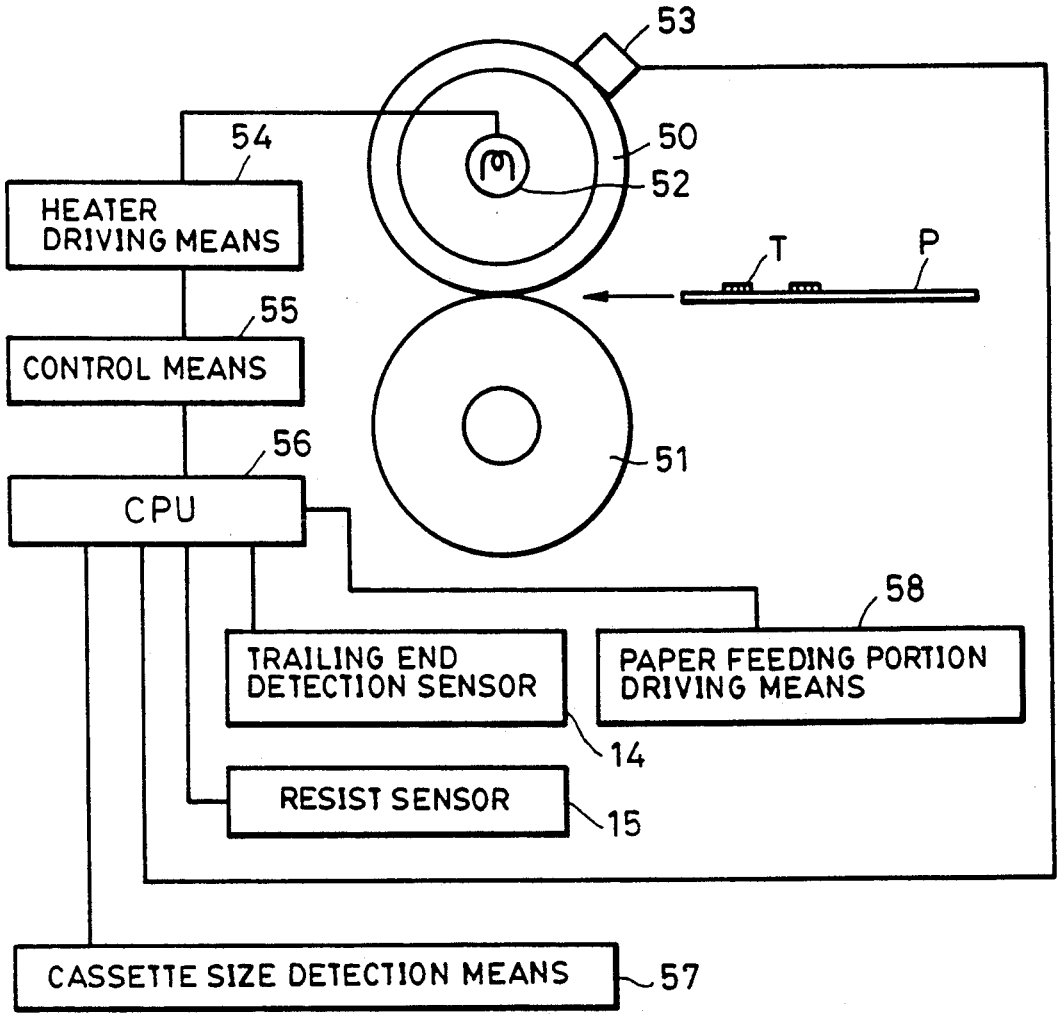
FIG. 4 is a drawing showing the construction of a fixing device of the present invention.

FIG. 4 shows the construction of the fixing device 16. In the drawing, reference numeral 50 denotes a heating roller comprising a pipe material made of aluminum, iron or the like with a thickness of 1.8 mm and an outer diameter of 18 mm and a PFA or PTFE releasing layer is coated on the pipe like material. A pressure roller 51 is disposed in contact with the heating roller 50 under a total pressure of 7 kg. Pressure roller 51 has a roller hardness of 45 degrees (Asker C) and an outer diameter of 18 mm and comprises a core metal having a diameter of 8 mm and a heat resistant elastic layer made of silicone rubber, fluorine rubber or the like formed thereon. When the recording material P passes between the heating roller (heating member) 50 and the pressure roller (backup member) 51, the toner image T on the recording material P is fixed by heat and pressure between the heating roller 50 and the pressure roller 51. Heating roller 50 contains a heater 52 for internally heating the heating roller 50. A temperature detection element 53, serving as temperature detection means contacts the surface of heating roller 50 to detect the temperature of the heating roller 50. Control means 55 for heater driving means 54 controls heater driving means 54 on the basis of data output from temperature detection element 53 so as to intermittently drive the heater 52. This enables the surface temperature of the heating roller 50 to be kept at a predetermined set temperature (print temperature) or a stand-by temperature during non-fixing.

Figure 5:
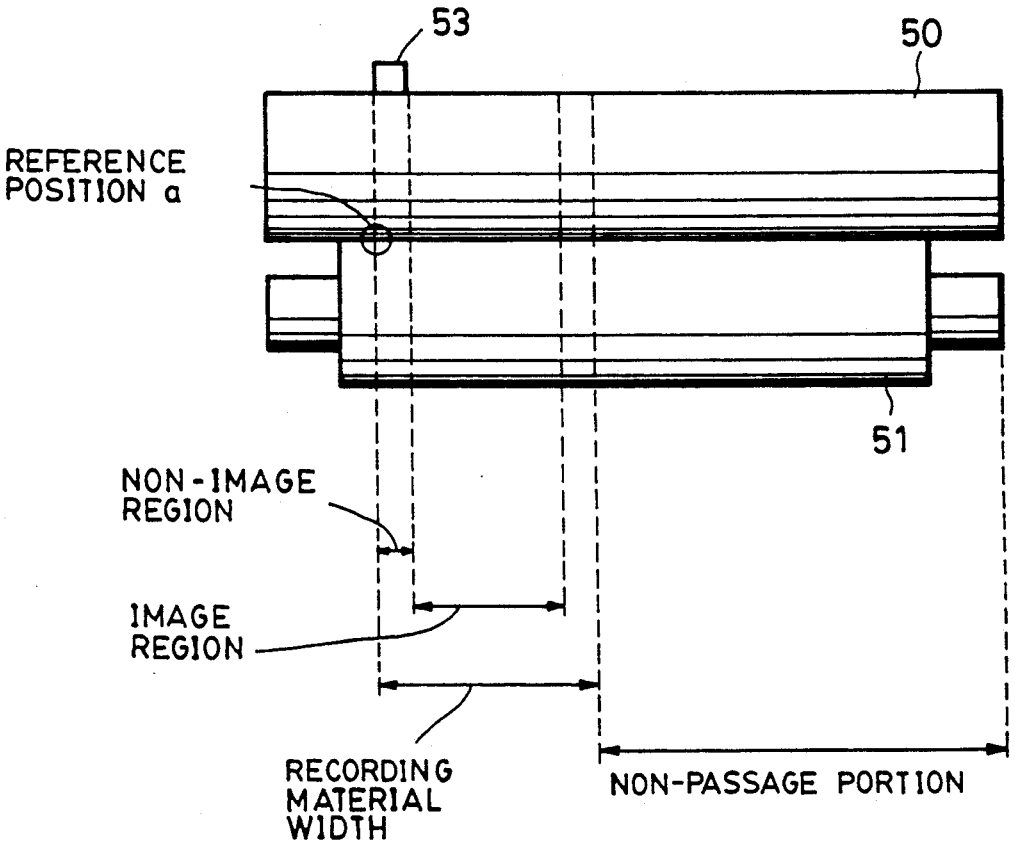
FIG. 5 is a drawing showing the construction of a fixing device of the present invention.

In addition, the fixing device 16 of the present invention has a structure of a one-side reference type in which the temperature detection element 53 is disposed in a passage region and in a non-image region on the recording material, and one edge of the recording material constantly passes through point a on the heating roller (fixing roller) 50 regardless of the size of the recording material, as shown in FIG. 5.

In the fixing device 16, the diameter of each of the heating and pressure rollers is reduced to 18 mm in order to decrease their cost and size. Since the nip is thus as small as about 2 mm, the energy to be supplied to the recording material is decreased. In addition, since the process speed (drum circumferential speed) Vp is 50 (mm/sec), and the throughput (sheets of paper fed per minute) of ordinary recording materials (A4 size or the like) is 8 (sheets/min), the print temperature set immediately after startup is 200° C., higher than the temperature eventually set after a sufficient time has passed. The higher initial temperature improves the fixing properties until the pressure roller is sufficiently heated. In the present invention, the feed interval, not the feed speed, of the recording materials is changed to prevent an excessive increase in the temperature in the non-passage portion of the fixing roller. The rotational speeds of the photosensitive drum and the fixing roller are constant. This temperature control can ensure good fixing properties even if recording materials, each holding an unfixed image, are continuously fed to the fixing device from the feeding means immediately after startup in a low temperature environment such as at room temperature of 15° C. or less. The terms "the recording materials are continuously fed" mean that a plurality of recording materials are fed by a single print instruction such as one pressing of a print start button.

Figure 2:
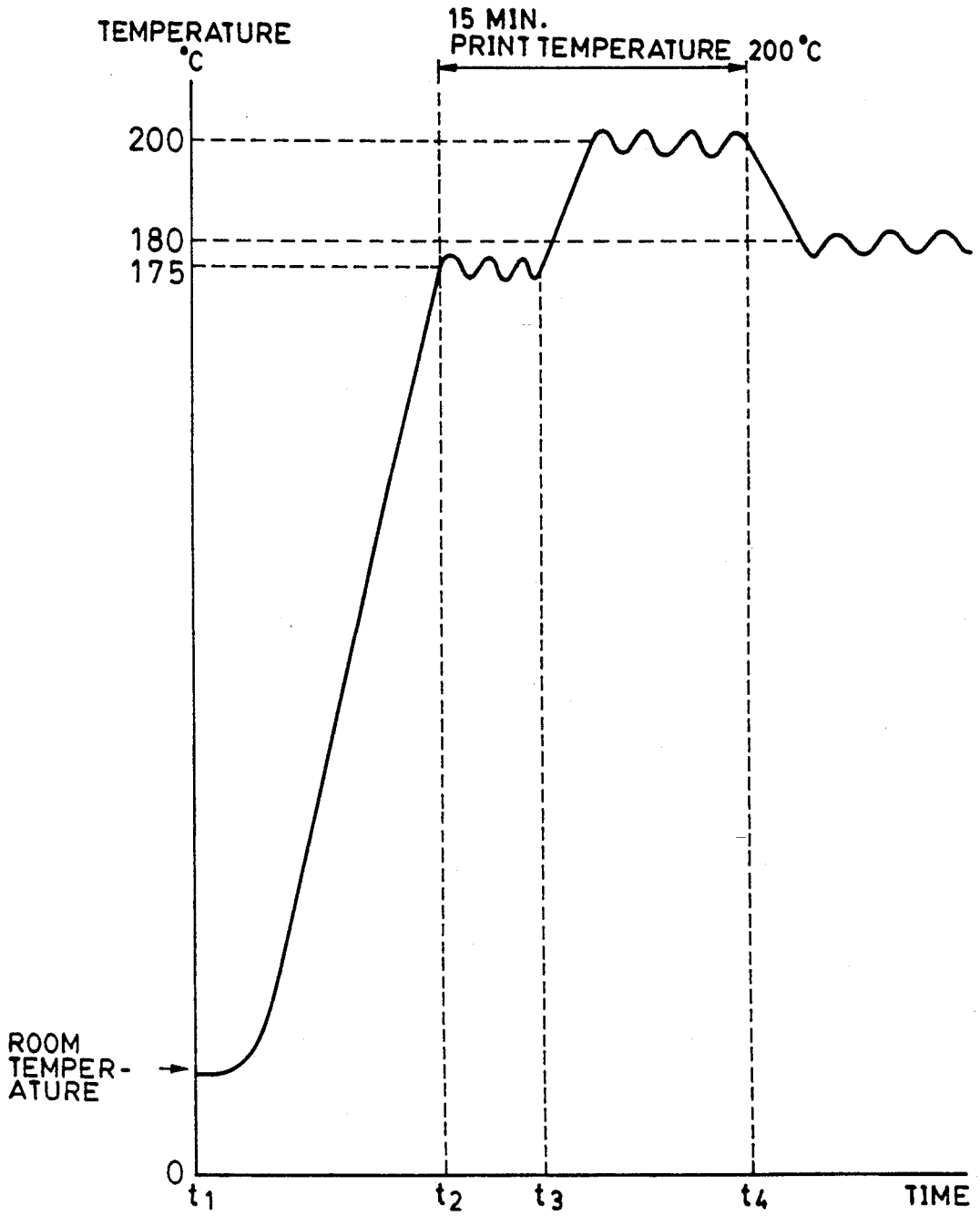
FIG. 2 is a graph showing the temperature control of a heating roller in accordance with the present invention.

The temperature control employed in the present invention is described below with reference to FIG. 2. The power source of the apparatus body is turned on at time $t_1$, and stand-by temperature control is started at time $t_2$ when the surface temperature of the heating roller is 175° C. Satisfactory fixing properties can be ensured by heating the roller surface at 175° C. for 15 minutes until time $t_4$. When printing is started at time $t_3$, since the pressure roller is not sufficiently heated, the print temperature is set to 200° C. (first set temperature) until time $t_4$ when the pressure roller is sufficiently heated. The print temperature is switched to 180° C. (second set temperature) at time $t_4$ whereupon the pressure roller is sufficiently heated to possess stable fixing properties. The reason for setting the time between $t_2$ and $t_4$ to 15 minutes is that if the stand-by temperature control at 175° C. is performed for 15 minutes or more, the pressure roller is sufficiently heated, and the fixing properties are stabilized. Because printing is performed under temperature control at 200° C. between the times $t_2$ and $t_4$, the fixing properties are stabilized even before the pressure roller is sufficiently heated. If the print temperature is reduced to 180° C. 15 minutes after the time $t_2$, the fixing properties remain stable because the pressure roller is now sufficiently heated. This temperature control enables minimization of an increase in the temperature and curling in the apparatus and improvement in the fixing properties immediately after startup in a low-temperature atmosphere.

Figure 6:
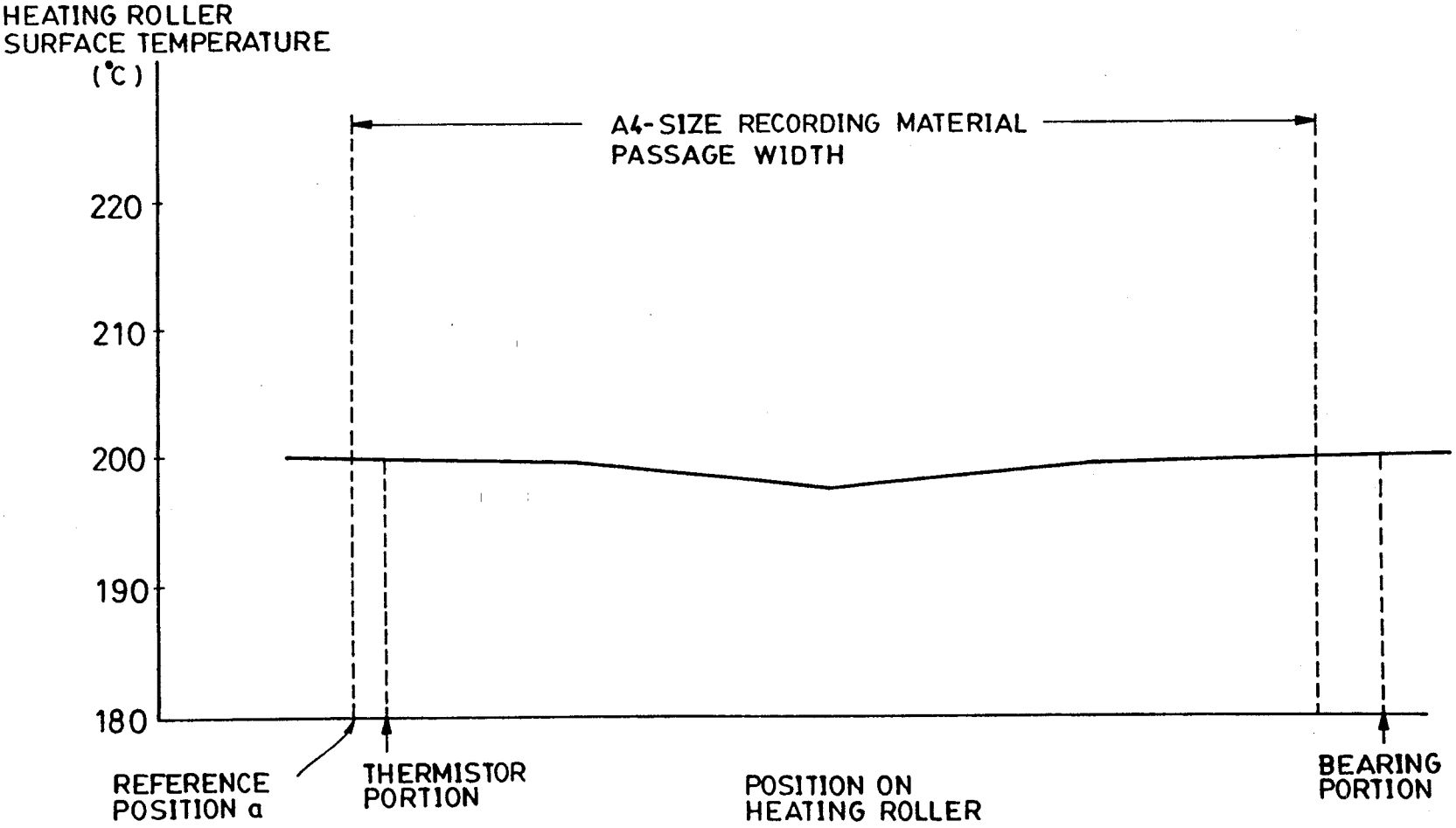
FIG. 6 is a graph showing the surface temperature of a heating roller of the present invention.
Figure 7:
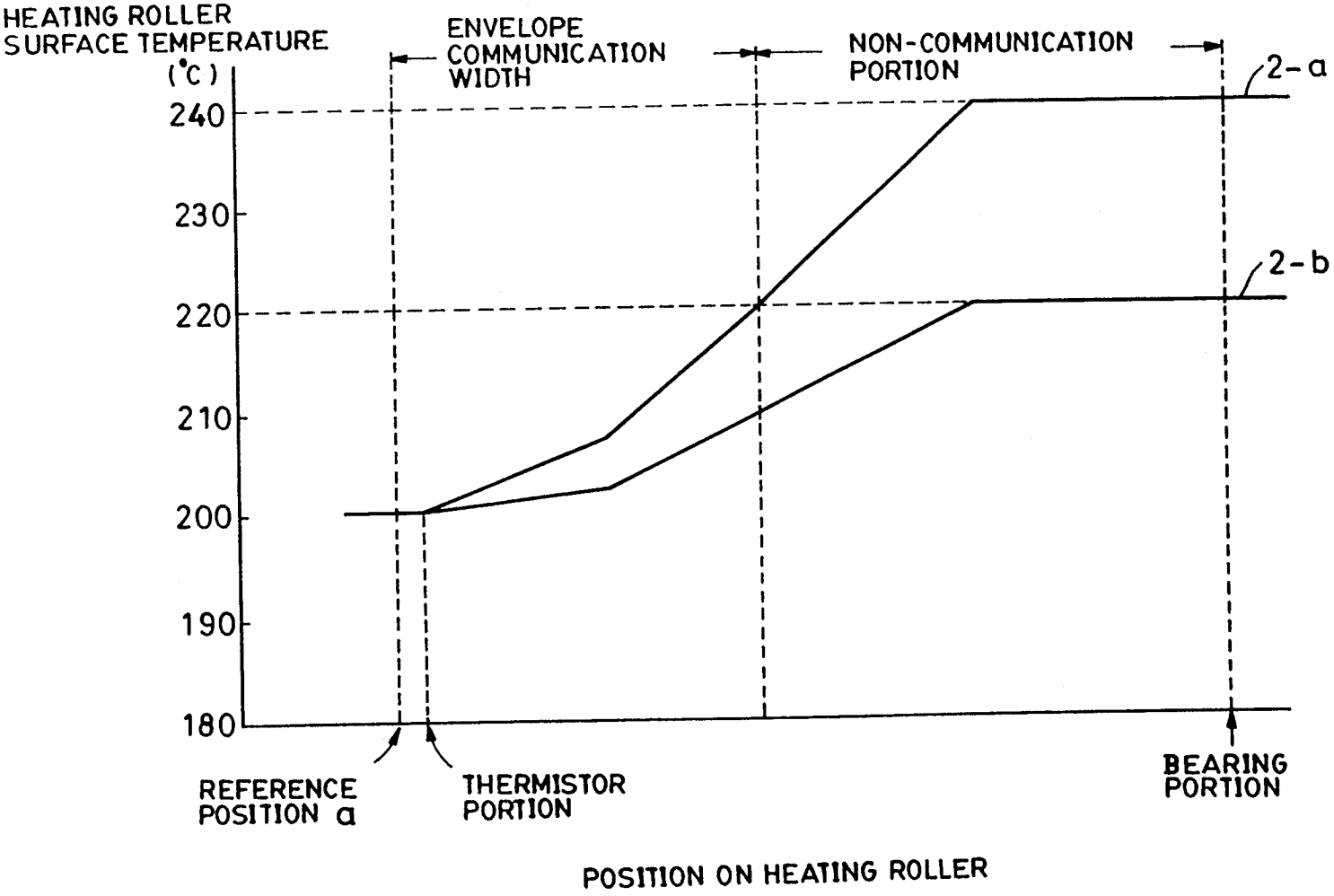
FIG. 7 is a graph showing the surface temperature of a heating roller of the present invention.
Figure 8:
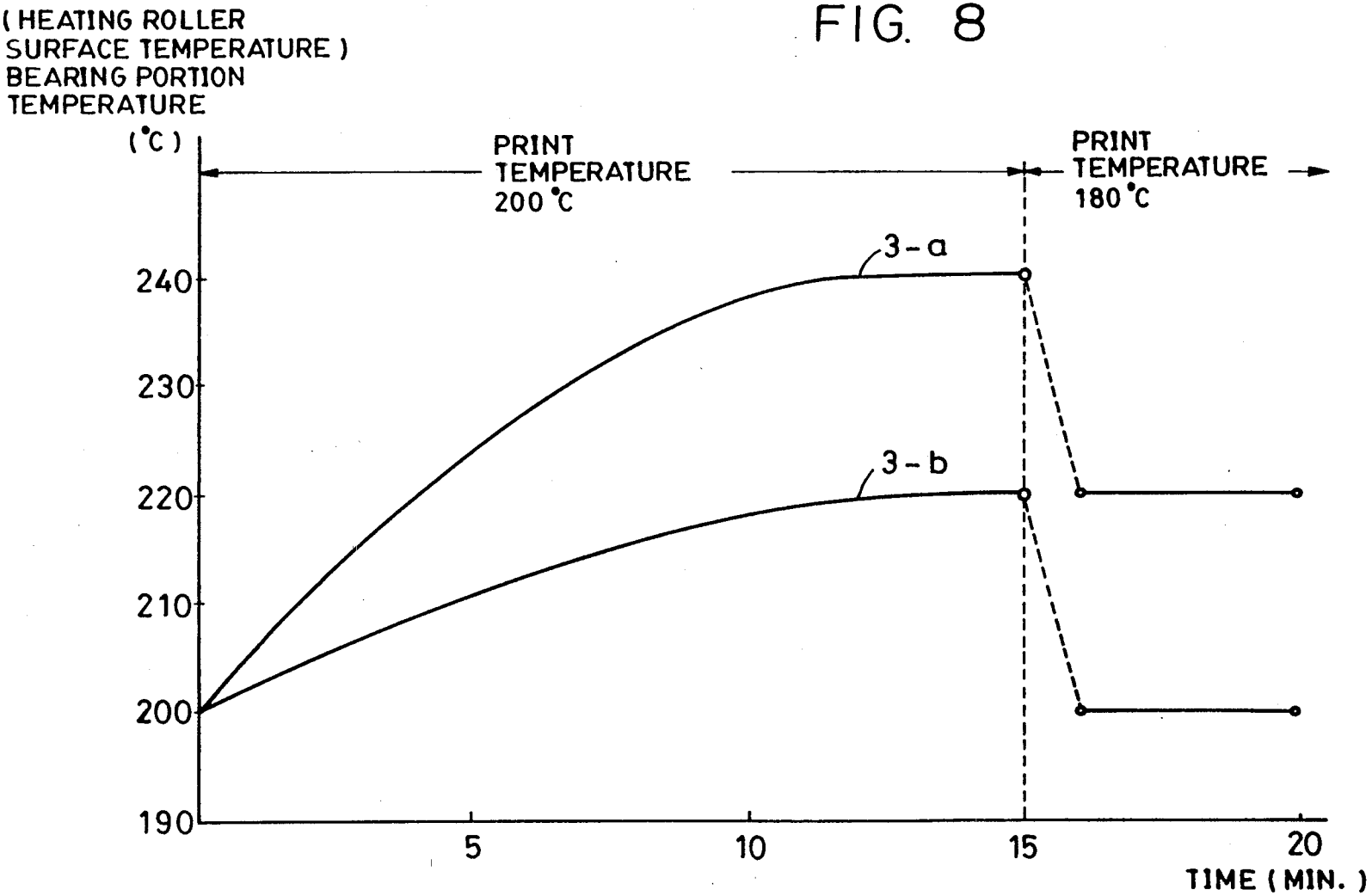
FIG. 8 is a graph showing the surface temperature of a heating roller of the present invention.

FIG. 6 shows the temperature distribution on the surface of the heating roller when A4-size recording materials (210×297 mm) are passed with a throughput 8 (sheets/min) and at a print temperature of 200° C. for 15 minutes immediately after startup. As seen from FIG. 6, when full size recording materials such as A-4 size are passed, the temperature distribution across the surface of the heating roller is substantially flat. However, in the fixing device having a structure of the one-side reference type (in which recording materials of various sizes are conveyed using one side end of each of the materials as a reference position) shown in FIG. 5 in which the temperature detection element 53 is disposed in a non-passage region of the fixing roller, when narrow recording materials such as envelopes or the like are passed, the surface temperature of the non-passage portion of the heating roller from which no heat energy is absorbed by the envelopes is increased. This phenomenon is shown in FIGS. 7 and 8. In FIG. 7, curve 2-*a* shows the temperature distribution on the surface of the heating roller when envelopes (106×241 mm) are passed at a throughput of 8 (sheets/min) and at a print temperature of 200° C. for 15 minutes immediately after startup. In FIG. 8, curve 3-*a* shows the temperature increase of the bearing portion in the non-passage portion of the heating roller during the passage under the same conditions as those of the curve 2-*a* shown in FIG. 7. As seen from the curves 2-*a* and 3-*a*, when envelopes are passed at a throughput of 8 (sheets/min) and at a print temperature of 200° C. for 15 minutes, the temperature of the bearing portion of the heating roller reaches about 240° C. That temperature generally exceeds the heat resistant temperature of the bearing portion of the heating roller.

The bearings for heating rollers are generally based on PPS (polyphenylene sulfide) resin and have a heat resistant temperature of about 230° C. When narrow envelopes are continuously passed at a throughput of 8 (sheets/min) and at a print temperature 200° C., there is thus the danger of damaging the bearing of the heating roller.

When ordinary recording materials are passed at a throughput of 8 (sheets/min) in a one-side reference type apparatus, as the present invention, since the temperature of the passage portion of the surface of the heating roller in contact with the thermistor serving as the temperature detection element is controlled during printing, while heat energy is absorbed by recording materials, the temperature of the passage portion is lower than that of the non-passage portion.

In addition, since the temperature of the non-passage portion of the surface of the heating roller is high because no heat energy is directly absorbed by recording materials, the heat energy conducts to a portion of the surface at a lower temperature. However, when the throughput is 8 (page/min), since the amount of heat energy supplied from the heater by temperature control during printing is greater than the amount of heat energy conducted, heat energy accumulates in the non-passage portion of the heating roller, and the temperature of the non-passage portion of the surface of the heating roller is higher than that of the passage portion thereof.

At this time, the difference between the temperatures of the passage portion of the surface of the heating roller in contact with the thermistor for detecting the temperature and of the bearing portion in the non-passage portion of the heating roller is about 40° C.

In order to decrease the difference between the temperatures of the passage portion and of the non-passage portion, the amount of the heat energy supplied from the heater should be less than that of the conducted heat energy. In order to decrease the amount of the heat energy supplied from the heater, the print temperature may be decreased by decreasing the number of times of turning-on of the heater, or the throughput may be decreased. However, a decrease in the fixing temperature makes it difficult to ensure good fixing properties immediately after startup in a low-temperature environment. In the present invention, when narrow envelopes are passed, the throughput is thus changed in accordance with the fixing temperature. Namely, the feed interval at the first set temperature is different from that at the second set temperature during continuous feeding of recording materials. FIG. 4 shows a CPU 56 serving as means for controlling the feed interval.

In this embodiment, when narrow recording materials such as envelopes or the like are passed at a fixing temperature of 200° C., i.e., the first set temperature, the throughput is 4 (sheets/min). FIGS. 7 and 8 show the increase in the temperature of the non-passage portion of the surface of the heating roller during the passage of the envelopes. In FIG. 7, curve 2-*b* shows the temperature distribution of the surface of the heating roller when envelopes (106×249 mm) are passed with a throughput of 4 (sheets/min) at a fixing temperature of 200° C. for 15 minutes immediately after startup. In FIG. 8, curve 3-*b* shows an increase in the temperature of the bearing portion of the heating roller when envelopes are passed under the same conditions as those of the curve 2-*b* shown in FIG. 7. As seen from the curves 2-*b* and 3-*b*, when envelopes are passed at a print temperature of 200° C. with a throughput of 4 (sheets/min) for 15 minutes, since the temperature of the bearing portion of the heating roller is about 220° C., which is lower than the 230° C. heat resistant temperature of the heating roller bearing, the fixing roller is not broken.

Figure 9:
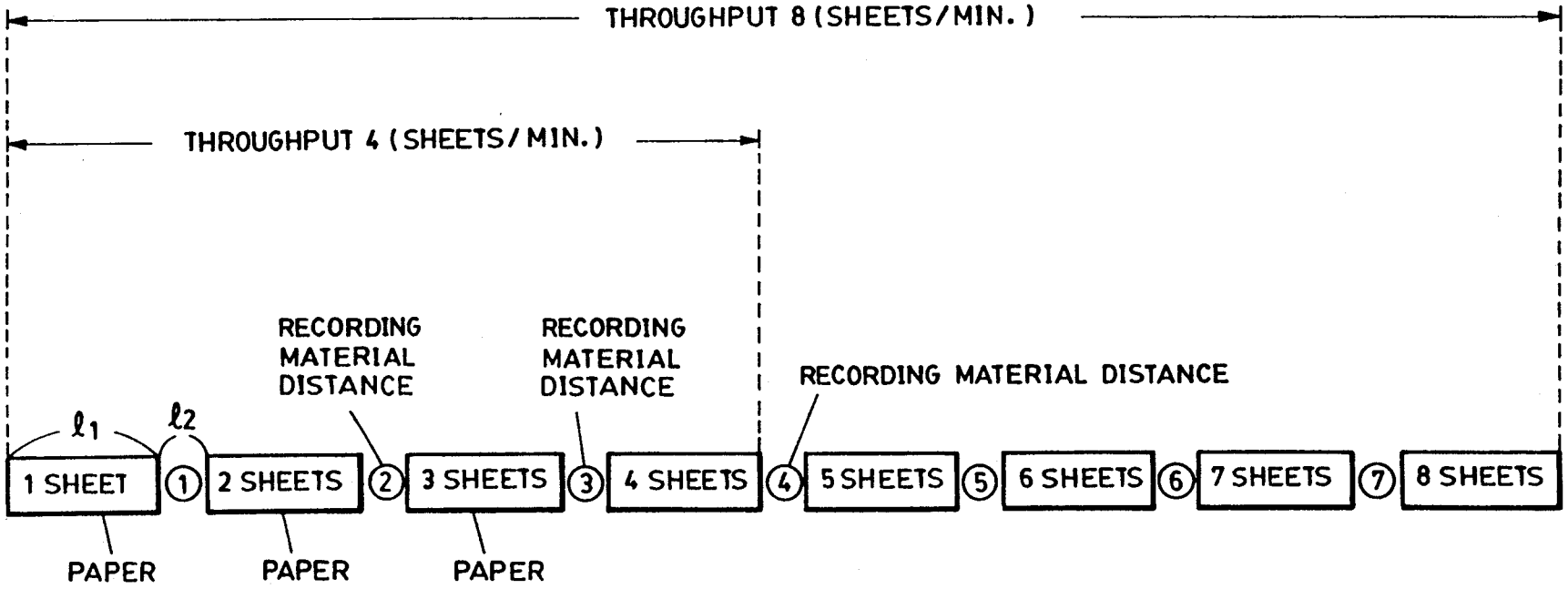
FIG. 9 is a drawing showing passage means of the present invention.

In this embodiment, the size (including the thickness) of a recording material is measured by the trailing end detection sensor so that the feed interval for ordinary recording materials is changed when envelopes are passed. The size of a recording material can be determined by measuring the time T taken from the entrance of the leading end of the recording material into the trailing end detection sensor to the separation of the trailing end therefrom and calculating the length $l_1$ (mm) of paper in the direction of conveyance thereof from the time T measured and the process speed $V_p=50$ (mm/sec) according to the equation $l_1=50\times T$ (mm/sec). Since the length of a long envelope in the direction of conveyance is about 106×241 mm, if the length $l_1 \leqq 241$ (mm), it is decided that an envelope is passed. However, making allowance for measurement error, when $l_1 \leqq 245$ (mm), it is decided that envelope is passed. The detection of the size of a recording material is not limited to this, and the size in the lengthwise direction of the fixing roller may be detected, or the size may be decided from the paper feeding cassette. Although, in this embodiment, the size of the recording material is decided by the trailing end detection sensor, the size may be decided by the register sensor. In addition, in this embodiment, the throughput is switched from 8 (sheets/min) to 4 (sheets/min) or vice versa by controlling the feed interval using the trailing end detection sensor. FIG. 9 shows the method of determining the feed interval. Assuming that the length in the direction of conveyance is $l_1$ (mm), the interval to be determined is $l_2$ (mm), and the process speed $V_p=50$ (mm/sec), the interval $l_2$ at a throughput of 8 (sheets/min) is $(50\times 60-8\times l_1)/7$, and the paper interval 12 at a throughput of 4 (sheets/min) is $(50\times 60-4\times l_1)/3$. In this way, it is decided by detecting the length of a recording material in the direction of conveyance thereof whether or not the width of the recording material is less than the envelope size. This permits a decision to be made as to whether or not the width of the recording material is the envelope size without using a width detection sensor. In addition, since the feed interval for recording materials during printing can be controlled on the basis of the difference in width cf recording materials, when narrow recording materials such as envelopes or the like are continuously passed, the increase in the temperature of the non-passage portion can be minimized.

Figure 1:
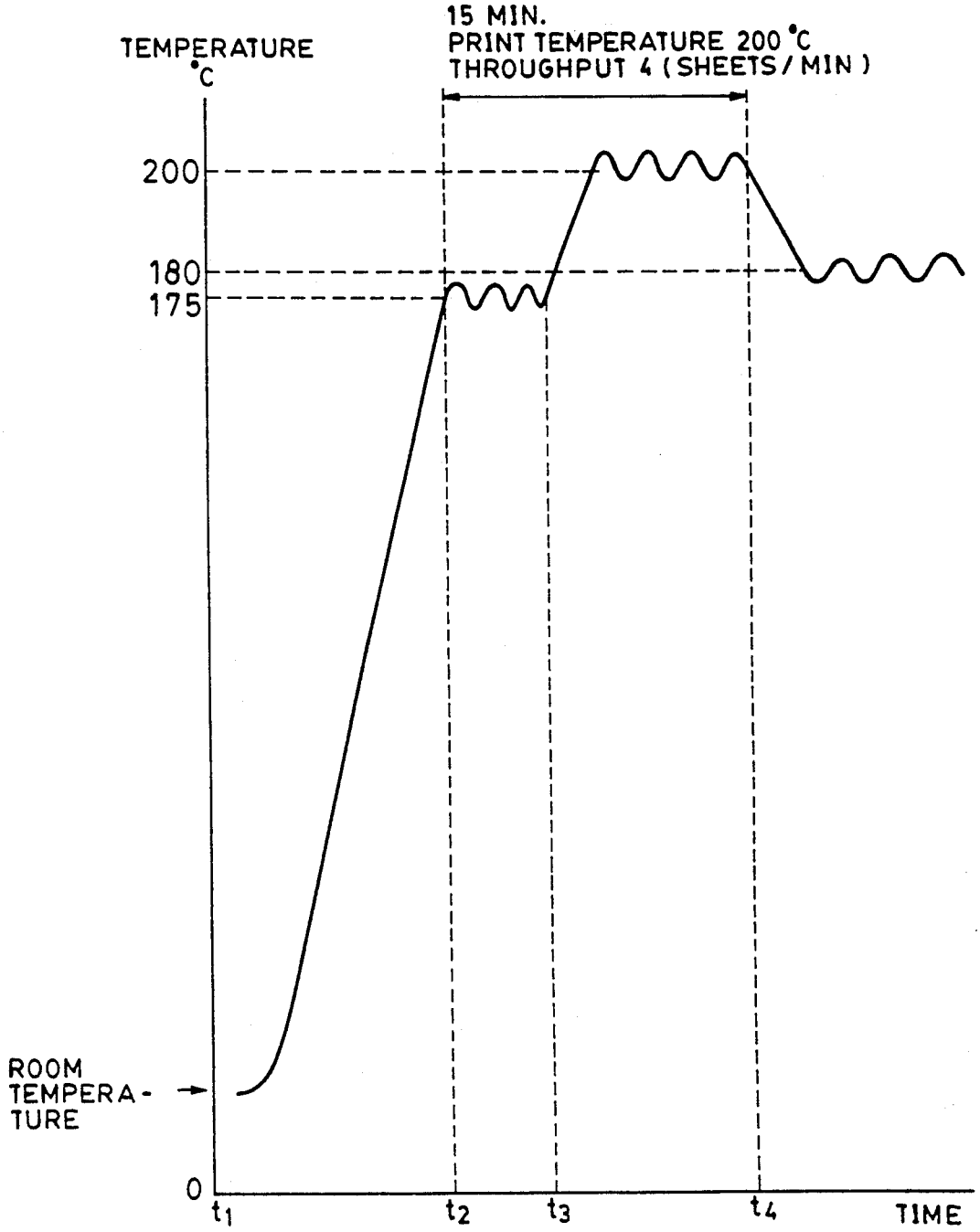
FIG. 1 is a graph showing the temperature control of a heating roller in accordance with the present invention.

FIG. 1 shows the temperature control when narrow recording materials such as envelopes or the like are passed in the embodiment constructed as described above. The power source of the apparatus body is turned on at time $t_1$, and stand-by temperature control is started at time $t_2$ when the surface temperature of the heating roller is 175° C. When printing of envelopes is started at time $t_3$, print temperature is controlled at the first set temperature, 200° C., until the pressure roller is sufficiently heated, by using a throughput of 4 (sheets/-min). The print temperature is then switched to the second set temperature of 180° C. at time $t_4$, when the pressure roller is sufficiently heated to have stable fixing properties. At the same time, the throughput is switched to 8 (sheets/min). The print temperature is switched 15 minutes after the time $t_2$ shown in FIG. 1. The reason for setting a distance of 15 minutes between the times $t_2$ and $t_4$ is that if the stand-by temperature control at 175° C. is performed for at least 15 minutes, the pressure roller is sufficiently heated, and the fixing properties are stabilized. Even when printing is performed between the times $t_2$ and $t_4$, the fixing properties are stabilized 15 minutes after the time $t_2$. In addition, since the throughput is 4 (sheets/min) when envelopes or the like are passed at the print temperature set to 200° C., if envelopes are passed immediately after startup, the temperature of the bearing portion in the non-passage portion of the heating roller is about 220° C., and thus the bearing of the heating roller is not broken. After 15 minutes has passed, if the print temperature is switched to 180° C., the fixing properties are stable because the pressure roller is sufficiently heated. At this time, although the throughput is switched to 8 (sheets/min), the temperature of the bearing portion of the heating roller is stable at about 220° C.

The above temperature control and switching of the throughput can suppress the increase in the surface temperature of the non-passage portion of the heating roller and prevent the breakage of the bearing portion of the heating roller even when narrow recording materials such as envelopes or the like are passed. It is also possible to improve the fixing properties immediately after startup in a low-temperature environment. Further, since the print temperature is decreased 15 minutes after the startup, curling is minimized.

EMBODIMENT 2

The image forming apparatus used in this embodiment has the same one-side reference type structure as that of the image forming apparatus used in Embodiment 1. The print temperature is controlled to 200° C. for 15 minutes immediately after startup in order to improve the fixing properties until the pressure roller is sufficiently heated in the same way as Embodiment 1.

In Embodiment 1, when narrow recording materials such as envelopes or the like are continuously passed, the throughout is switched by controlling the interval between envelopes in accordance with the print temperature so that the temperature of the bearing portion of the heating roller is lower than the heat resistant temperature of the bearing. In Embodiment 2, when envelopes or the like are passed at a print temperature of 200° C., the paper interval is the same as that with a throughput of 4 (sheets/min), and a non-passage time of 90 seconds is provided at an interval of 24 sheets so that the temperature of the bearing portion of the heating roller is kept lower than the heat resistant temperature of the bearing.

In this embodiment, the fixing device has the same one-side reference type structure as that in Embodiment 1, and the print temperature is set to 200° C. for 15 minutes immediately after startup. When recording materials are passed with a throughput of 8 (sheets/-min), the temperature of the non-passage portion in the bearing portion of the heating roller thus reaches 240° C. and exceeds 230° C. which is the heat resistant temperature of the bearing, as in Embodiment 1. There is thus the danger of damaging the bearing. This is caused by an increase in the temperature of the non-passage portion of the surface of the heating roller from which no heat energy is directly absorbed by the recording materials. Although the heat energy in a portion at high temperature is moved to a portion at low temperature, since the quantity of heat energy supplied from the heater by temperature control during printing is greater than that of heat energy moved in the case of a throughput of 8 (sheets/min), heat energy is accumulated in the non-passage portion of the heating roller, and the temperature of the non-passage portion on the surface of the heating roller is higher than that of the passage portion thereof.

At this time, the difference between the temperatures of the surface of the heating roller in contact with the thermistor for detecting the temperature and of the non-passage portion in the bearing portion of the heating roller is about 40° C.

In order to decrease the difference between the temperatures of the passage portion and the non-passage portion on the surface of the heating roller, the quantity of the heat energy supplied from the heater may be decreased to a value smaller than the quantity of heat energy conducted Namely, in order to decrease the quantity of the heat energy supplied from the heater, the number of times of turning-on of the heater may be decreased. In the present invention, when narrow recording materials such as envelopes or the like are passed at a print temperature of 200° C. for 15 minutes immediately after startup, the interval is the same as that with a throughput of 8 (sheets/min), and a non-passage time, i.e , a time for temporarily stopping continuous paper feeding, is provided at intervals of predetermined sheets.

Figure 10:
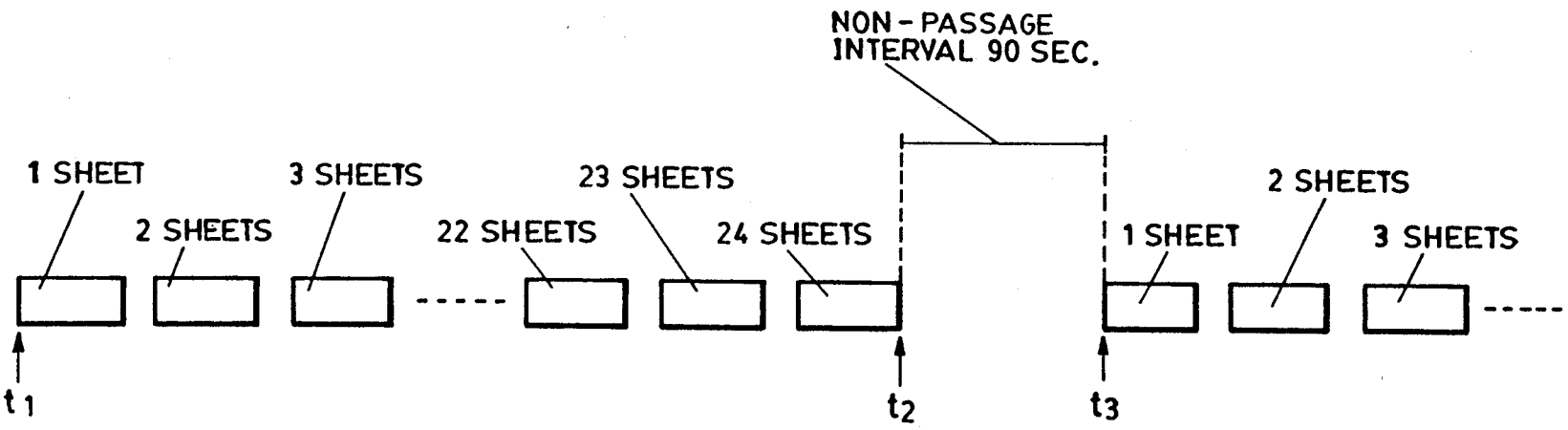
FIG. 10 is a drawing showing passage means of the present invention.

FIG. 10 shows the method of passing recording materials in this embodiment. When the print temperature is 200° C. for 15 minutes immediately after startup, the passage of envelopes is started at time $t_1$. At this time, the interval is the same as that with a throughput of 8 (sheets/min). In this state, the passage is stopped at time $t_2$ after 24 sheets have passed, and a non-passage interval is provided for idling the fixing device under temperature control at 200° C. After the idling for 90 seconds, the sheet passage resumes at $t_3$.

This passage is repeated during the time the print temperature is 200° C.

Figure 11:
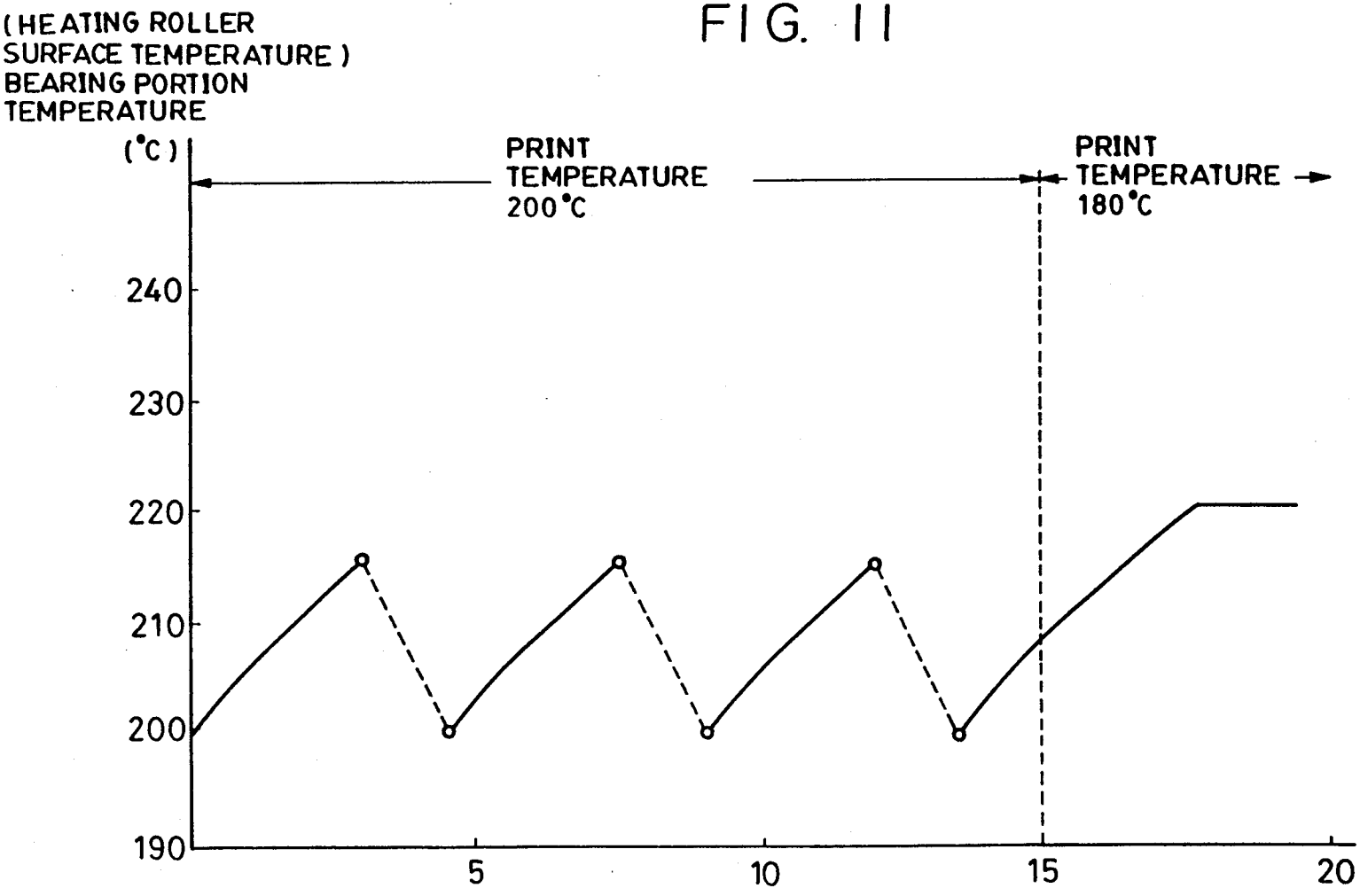
FIG. 11 is a graph showing the surface temperature of a heating roller of the present invention.

The maximum time that the print temperature is kept at 200° C. is 15 minutes immediately after startup. The increase in the temperature of the bearing portion on the non-passage portion of the heating roller during this time is as shown in FIG. 11. As seen from FIG. 11, when a non-passage time of 90 seconds is provided at intervals of 24 sheets for idling the fixing device under temperature control at 200° C. with the same feed interval as that with a throughput of 8 (sheets/min), the surface temperature of the heating roller is decreased by about 15° C. during the non-passage time. This is caused by a decrease in the number of times the heater is turned on, a decrease in quantity of the heat energy supplied to the heating roller and the movement of heat energy in the heating roller within the non-passage time. In this state, when envelopes are passed for 15 minutes, the temperature of the bearing portion of the surface of the heating roller on the one-passage side thereof is about 215° C. which is lower than the heat resistant temperature of the bearing. This embodiment can prevent the breakage of the bearing during passage of recording materials.

When the temperature is controlled to the stand-by temperature of 175° C. or the print temperature of 200° C. for 15 minutes immediately after startup, if the print temperature is then switched to 180° C., the fixing properties are stable because the pressure roller is sufficiently heated. In addition, since the throughput of envelopes is switched to the usual value of 8 (sheets/-min) at the same time as switching of the print temperature to 180° C., the temperature of the bearing portion of the heating roller on the side of the non-passage portion thereof is 220° C.

The above temperature control and the passage enable the user to constantly print with a throughput of 8 (sheets/min) if the user desired to intermittently print images on about 20 envelopes . When the throughput is 4 (sheets/min) for 15 minutes immediately after startup, although printing can be performed on about 60 sheets for 15 minutes, the passage according to this embodiment enables printing on about 78 sheets immediately after startup. The fixing properties immediately after startup in a low-temperature environment can also be improved. Further, since the print temperature is decreased 15 minutes after the startup, the internal temperature of the apparatus and curling can be minimized.

EMBODIMENT 3

The image forming apparatus used in this embodiment has the same one-side reference type structure as that of the image forming apparatus used in Embodiment 1. The print temperature is controlled to 200° C. for 15 minutes immediately after startup in order to improve the fixing properties until the pressure roller is sufficiently heated, as in Embodiment 1.

In Embodiment 2, when narrow recording materials such as envelopes or the like are passed, a predetermined non-passage time is provided at intervals of predetermined sheets so that the temperature of the bearing portion of the heating roller is lower than the heat resistant temperature of the bearing, thereby causing a slight increase in the temperature of the bearing portion of the heating roller In Embodiment 3, when envelopes are passed at the print temperature of 200° C., the feed interval is the same as that with a throughput of 8 (sheets/min), and a predetermined non-passage time is provided at intervals of predetermined sheets under temperature control at 175° C.

In this embodiment, since the fixing device has the same one-side reference type structure as that in Embodiment 1, and the print temperature is 200° C. for 15 minutes immediately after startup, when recording materials are passed with a throughput of 8 (sheets/min), the temperature of the bearing portion of the heating roller on the side of the non-passage portion thereof reaches 240° C. and exceeds 230° C. which is the heat resistant temperature of the bearing, as in Embodiment 1. There is thus the danger of breaking the bearing. This is caused by an increase in the temperature of the non-passage portion of the surface of the heating roller from which no heat energy is directly absorbed by recording materials. The heat energy in a portion at a high temperature is moved to a portion at a low temperature. However, in the case of a throughput of 8 (sheet/min), since the quantity of the heat energy supplied from the heater by temperature control during printing is greater than that the heat energy moved, heat energy is accumulated in the non-passage portion of the heating roller, and the temperature of the non-passage portion on the surface of the heating roller is thus higher than that of the passage portion thereof.

At this time, the difference between the temperatures of the thermistor portion which contacts the surface of the heating roller so as to detect the temperature and of the bearing portion of the heating roller in the non passage portion thereof is about 40.

In order to decrease the difference between the temperatures of the passage portion and of the non-passage portion of the surface of the heating roller, the quantity of the heat energy supplied from the heater may be decreased to a value lower than that of the heat energy conducted. In order to decrease the quantity of the heat energy supplied from the heater, the number of times of turning-on of the heater may be decreased. In the present invention, when narrow recording materials such as envelopes or the like are passed, at the print temperature of 200° C. for 15 minutes immediately after the startup, the feed interval is the same as that with a throughput of 8 (sheets/min), and a predetermined non-passage time is provided at intervals of a predetermined number of sheets. During the non passage time, the temperature is controlled at 175° C.

Figure 12:
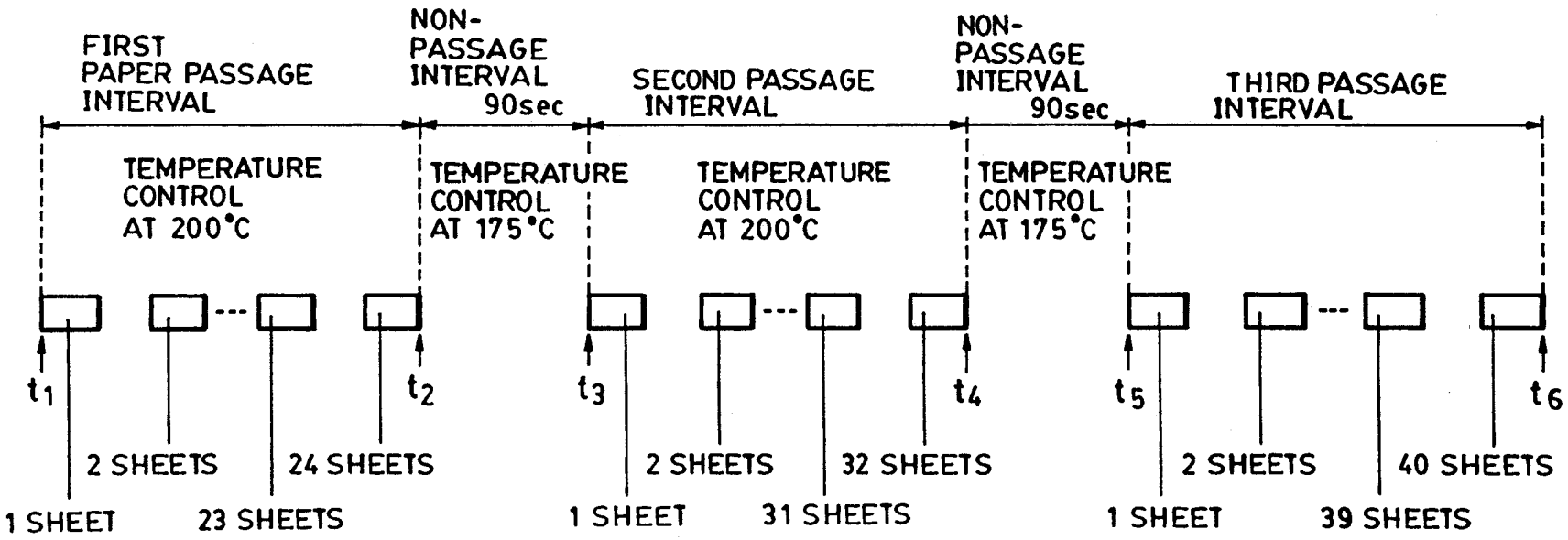
FIG. 12 is a drawing showing passage means of the present invention.

FIG. 12 shows the control of the passage and the interval in this embodiment. When the print temperature is 200° C. for 15 minutes immediately after the startup, the passage of envelopes is started at time $t_1$. At this time, the feed interval is the same as that with a throughput Of 8 (sheets/min). A first passage interval during which 24 envelopes are passed under the same conditions is provided between times $t_1$ and $t_2$. The passage is stopped at time $t_2$, and at the same time, the temperature is controlled at 175° C. A non-passage time in which the fixing device is idled at the same temperature is provided. After the idling is continued for 90 seconds, the print temperature is set to 200° C., and the passage is started again. A second passage interval is provided between times $t_3$ and $t_4$ in which 32 envelopes are passed. The passage is stopped at time $t_4$, and at the same time, the temperature control is set at 175° C. A non-passage time is provided for idling the fixing device at the same temperature. After the fixing device is continuously idled for 90 seconds, the print temperature control is set to 200° C., and the passage is started again. The passage is then repeated during the time the print temperature is controlled at 200° C.

Figure 13:
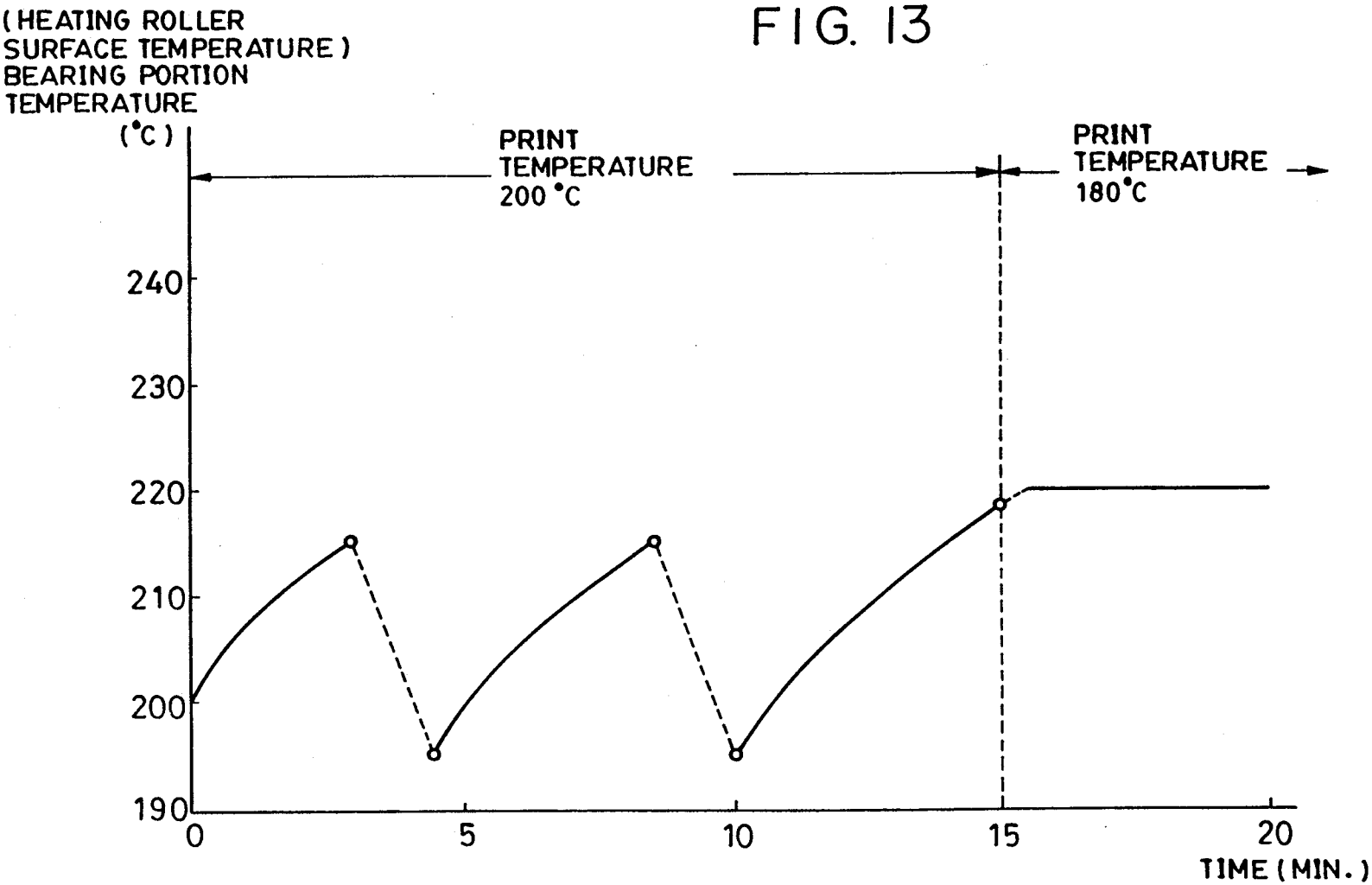
FIG. 13 is a graph showing the surface temperature of a heating roller of the present invention.

The maximum time the print is maintained at a temperature of 200° C. is 15 minutes when printing is started immediately after the startup. FIG. 13 shows the increase in the temperature of the bearing portion on the side of the non passage portion when envelopes are passed according to this embodiment. As seen from FIG. 13, since the temperature is decreased to 175° C. during the first non passage time for idling the fixing device, the surface temperature of the heating roller is decreased by about 20° C. when envelopes are passed. This is caused because the decrease in the temperature during the non-passage time decreases the number of times of turning-on of the heater and thus decreases the quantity of the heat energy supplied to the heating roller and causes the movement of the heat energy in the heating roller.

When recording materials are passed at a print temperature of 200° C. for 15 minutes immediately after the startup by employing this embodiment, the surface temperature of the heating roller is increased to 220° C. Since this temperature is lower than the heat resistant temperature of the bearing, the passage of recording materials by this embodiment can prevent the breakage of the bearing.

When the temperature is controlled at the stand-by temperature of 175° C. or the print temperature of 200° C. for 15 minutes immediately after the startup, even if the print temperature is then switched to 180° C., the fixing properties are stable because the pressure roller is sufficiently heated. In addition, since the throughput of envelopes is switched to the normal value of 8 (sheets/-min) at the same time as the switching of the print temperature to 180° C., the temperature of the bearing of the heating roller on the non passage side thereof is 220° C.

The temperature control and the passage of this embodiment enable the printing on 90 recording materials for 15 minutes when printing is started immediately after the startup When the printing on envelopes is intermittently performed, printing can be constantly performed on about 20 envelopes with a throughput of 8 (sheets/min). The temperature control and the passage of recording material of this embodiment also permit improvement in the fixing properties immediately after the startup in a low-temperature environment. In addition, since the print temperature is decreased 15 minutes after the startup, the internal temperature of the apparatus and curling can be minimized.

As described above, in the present invention, the feed interval during continuous feeding is changed according to the set temperature of the fixing roller when the set temperature is changed or according to the size of a recording material when the size of the recording material is changed. Alternatively, after the surface of the fixing roller assumes an image formation state, or after a predetermined time, i.e., after a state permitting image formation is established, the first feed interval is set and then switched to the second feed interval shorter than the first feed interval during the continuous feed of recording materials. The invention thus causes a slight increase in the temperature of the non-passage portion. This can suppress the increase in the internal temperature of the apparatus and can prevent the breakage of the bearing portion of the heating roller. It is also possible to fix images on an optimum number of sheets while ensuring stable fixing properties.

While the present invention has been described with respect to what is presently considered to be the preferred embodiments, it to be understood that the invention is not limited to the disclosed embodiments. The present invention is intended to cover various modifications and equivalent arrangements included within the spirit and scope of the appended claims.

What is claimed is:

1. An image forming apparatus comprising:

means for fixing an unfixed image on a recording material, said fixing means comprising a heating member selectively maintainable at one of at least a first set temperature and a second set temperature lower than the first set temperature during fixing, and a backup member forming a nip with said heating member so that said nip conveys a recording material holding an unfixed image thereon through said nip to fix the unfixed image;

feed means for continuously feeding recording materials on which there is an unfixed image to said fixing means; and feed interval control means for switching between a first feed interval at the first set temperature and a second feed interval shorter than the first feed interval at the second set temperature during continuous feeding of the recording materials.

2. An apparatus according to claim 1, wherein said heating member comprises a heating roller heated by a heater and supported by bearings made of a resin.

3. An apparatus according to claim 1, wherein said fixing means further comprises a temperature detection element for detecting the surface temperature of said heating member, said temperature detection element being provided within a passage region of a recording material.

4. An apparatus according to claim 3, wherein said temperature detection element is provided adjacent a reference position for passage of recording materials.

5. An apparatus according to claim 1, wherein said fixing means maintains the temperature of said heating member so that said first set temperature is higher than said second set temperature for a predetermined time after a power source of the apparatus body is turned on.

6. An image forming apparatus comprising:

a heating member for fixing;

temperature control means for maintaining said heating member at a predetermined set temperature during fixing;

a backup member forming a nip with said heating member to convey a recording material holding an unfixed image through said nip to fix the unfixed image;

feed means for continuously feeding recording materials at intervals to said nip for fixing an unfixed image on each of said recording materials;

size detection means for detecting a size of the recording material; and feed interval control means for controlling the feed interval of said recording materials on the basis of the results of detection by said size detection means;

wherein said feed interval control means makes the feed interval longer when said size detection means detects that a recording material has a small passage region in said nip.

7. An apparatus according to claim 6, wherein said heating member comprises a heating roller heated by a heater and supported by bearings made of a resin.

8. An apparatus according to claim 6, wherein said temperature control means further comprises a temperature detection element for detecting the surface temperature of said heating member, said temperature detection element being provided within a passage region of a recording material.

9. An apparatus according to claim 8, wherein said temperature detection element is provided adjacent a reference position for passage of recording materials.

10. An apparatus according to claim 6, wherein a smaller size recording material is an envelope.

* * * * *

UNITED STATES PATENT AND TRADEMARK OFFICE

CERTIFICATE OF CORRECTION

PATENT NO. : 5,289,247
DATED : February 22, 1994
INVENTOR(S) : MANABU TAKANO, ET AL.

It is certified that error appears in the above-indentified patent and that said Letters Patent is hereby corrected as shown below:

Column 6,
Line 52, "interval 12" should read --interval $l_2$--

Column 8,
Line 32, "conducted" should read --conducted.--.

Column 9,
Line 50, "roller" should read --roller.--.

Column 10,
Line 37, "Of" should read --of--.

Column 11,
Line 25, "startup" should read --startup.--.

Signed and Sealed this

Third Day of December, 1996

Bruce Lehman

*Attest:*

BRUCE LEHMAN

*Attesting Officer*

*Commissioner of Patents and Trademarks*